United States Patent [19]

Della Rovere

[11] 4,335,882

[45] Jun. 22, 1982

[54] SHEET-METAL TARGET PIGEON

[76] Inventor: Ludovico L. Della Rovere, Avenida Paez, Quinta Ismenia, El Paraiso, Caracas, Venezuela

[21] Appl. No.: 65,467

[22] Filed: Aug. 10, 1979

Related U.S. Application Data

[63] Continuation-in-part of Ser. No. 921,006, Jun. 30, 1978, Pat. No. 4,206,914, which is a continuation-in-part of Ser. No. 892,921, Apr. 3, 1978, Pat. No. 4,218,061, and a continuation-in-part of Ser. No. 882,907, Mar. 1, 1978, and a continuation-in-part of Ser. No. 762,019, Jan. 24, 1978, Pat. No. 4,133,532.

[51] Int. Cl.[3] ..... F41J 9/16

[52] U.S. Cl. ..... 273/363; 273/365; 273/364

[58] Field of Search ..... 273/363, 364, 365; 46/82–84

[56] References Cited

U.S. PATENT DOCUMENTS

| | | | |
|---|---|---|---|
| 957,742 | 5/1910 | Chiantore | 273/363 |
| 1,368,176 | 2/1921 | McMillan | 273/365 |
| 1,419,041 | 6/1922 | Gillen | 46/82 |
| 3,411,778 | 11/1968 | Barry | 273/363 X |
| 3,570,467 | 3/1971 | Belokin, Jr. | 273/364 X |

FOREIGN PATENT DOCUMENTS

| | | | |
|---|---|---|---|
| 687941 | 6/1964 | Canada | 273/363 |

*Primary Examiner*—Paul E. Shapiro
*Attorney, Agent, or Firm*—Karl F. Ross

[57] ABSTRACT

A target pigeon has a generally flat web formed entirely of sheet metal with a central throughgoing hole at a web axis and having a pair of diametrically opposite web ends from each of which extends a sheet-metal vane which is tipped propeller-fashion relative to the other vane. In addition each of the web ends has a respective substantially straight, axially projecting, and outwardly tipped sheet-metal tab of V-section. A cup-shaped witness cap entirely of sheet metal is fittable to this web and has a circular rim centered on a cap axis and having a pair of diametrically opposite and radially outwardly extending lips each of which is formed with a respective throughgoing aperture through which the tabs project to hold the cap releasably in place on the web.

15 Claims, 9 Drawing Figures

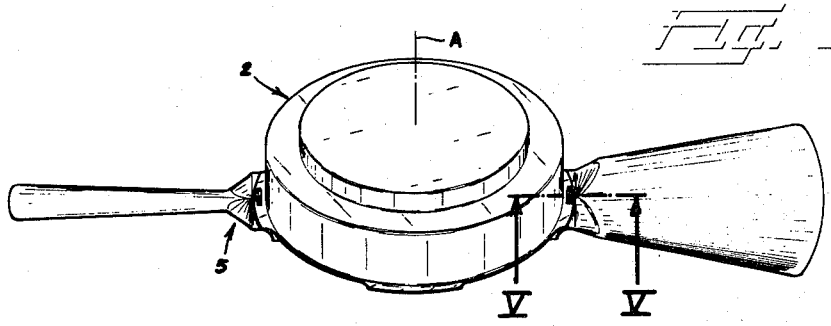
Fig. 1
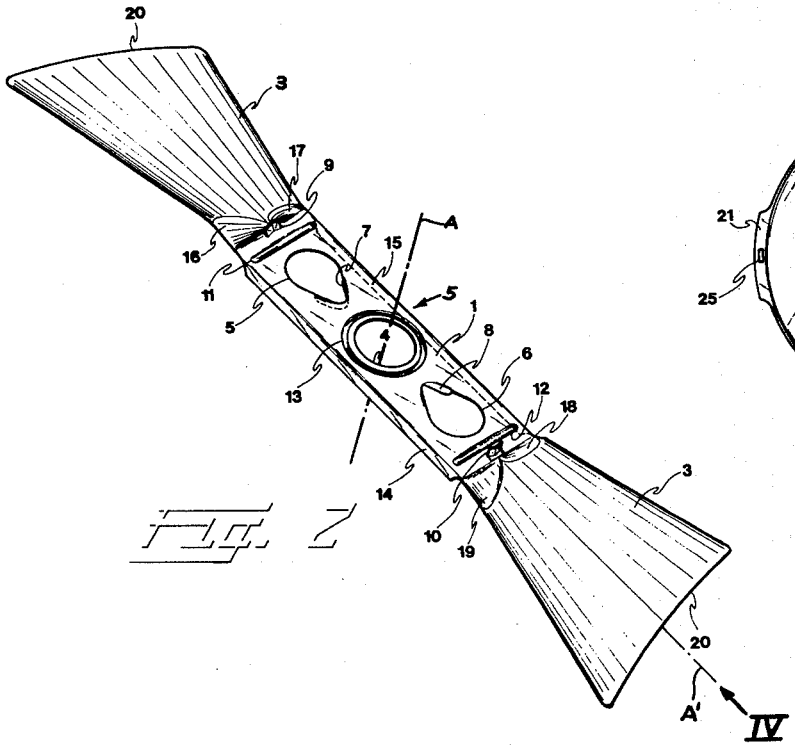
Fig. 2
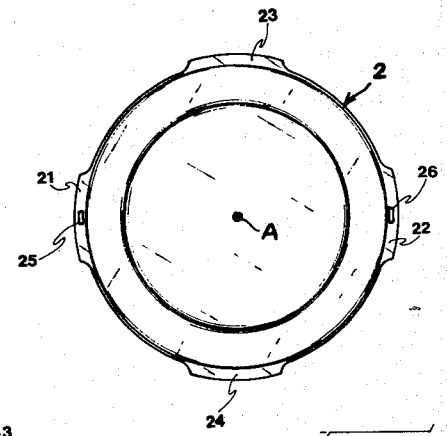
Fig. 3
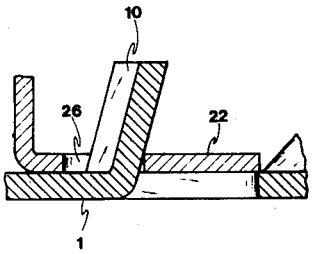
Fig. 5
Fig. 4
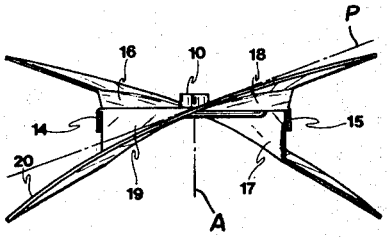

SHEET-METAL TARGET PIGEON

CROSS-REFERENCE TO RELATED APPLICATIONS

This application is a continuation-in-part of copending application Ser. No. 921,006 filed June 30, 1978 (now U.S. Pat. No. 4,206,914) as a continuation-in-part of my earlier applications Ser. Nos. 762,019 of Jan. 24, 1978 (now U.S. Pat. No. 4,133,532), 882,907 of Mar. 1, 1978, and 892,921 of Apr. 3, 1978 (now U.S. Pat. No. 4,218,061).

FIELD OF THE INVENTION

The present invention relates to a target pigeon. More particularly this invention concerns such a target pigeon usable with a launching apparatus such as described in my earlier U.S. Pat. No. 4,077,384.

BACKGROUND OF THE INVENTION

My earlier above-cited application Ser. No. 921,006 describes a target pigeon whose body part has a generally flat web formed with a central throughgoing hole and having a pair of diametrically opposite ends from each of which extends a respective vane, these vanes being tipped propeller-fashion to each other. The target pigeon also has a cup-shaped witness cap having a substantially circular rim centered on a cap axis and having an axially directed end engageable with the web at the ends thereof and fully exposed arcuate sides or sections diametrically flanking the web. An end plate extends across and closes this rim at the opposite axial end thereof. Means is provided including interengaging formations on the ends of the web and on the rim for releasably securing the body part and witness cap together with the web and cap axis aligned and the one end of the rim bearing on the web ends thereof. This means frees the cap from the ring when the cap is impacted.

The above-described target pigeon has proven extremely popular in sporting use, as its flight trajectory closely resembles that of a live pigeon. Thus it is possible for a target shooter to practice with a system that closely duplicates the conditions of live-bird shooting. The use of a device rather than a live bird eliminates any objections on ethical grounds, while substantially reducing the cost of such target shooting.

Nonetheless several disadvantages have been noted. To date targets have invariably been made of synthetic resin, although it has been suggested to cast them of a light metal such as aluminum or magnesium. Even when made of an extremely durable synthetic resin, such as polycarbonate, eventually the target pigeons wear out and must be replaced. If used in the field parts of such synthetic-resin target pigeons must be collected, as they are non-biodegradable. Even when collected they represent a disposal problem. Another disadvantage is that the cost of synthetic resins is directly related to the cost of the petroleum from which they are made, so that as the cost of petroleum increases inordinately, so does the cost of a synthetic-resin target pigeon.

OBJECTS OF THE INVENTION

It is therefore an object of the present invention to provide an improved target pigeon.

Another object is to provide a target pigeon which can be produced at very low cost.

Another object is to provide a target pigeon which is environmentally inoffensive.

Another object is to provide a target pigeon which when shot will provide an even better indication of a successful hit than the prior-art pigeons.

SUMMARY OF THE INVENTION

These objects are attained according to the instant invention in a target pigeon of the above-described general type, but wherein the web and cap are both formed completely of sheet metal. In accordance with this invention the web ends of the cap are each provided with a substantially straight and generally axially projecting sheet metal tab. These tabs are outwardly tipped and diametrically opposite each other. Their axial heights above the web are substantially greater than the thickness of the sheet metal forming the cap. In turn the cap is formed at the end of its rim opposite its closing end plate with a pair of outwardly directed diametrically opposite lips each formed with a throughgoing aperture. According to this invention the sheet-metal tabs of the web engage through these apertures and in fact constitute the sole holding and centering means for the cap on the web.

It has been found that when making these target pigeons of sheet metal it is necessary to substantially redesign them. The standard attachment employing on one of the parts of the pigeon a pair of axially extending and diametrically opposite legs having radially deflectable feet that can engage radially inwardly or outwardly over oppositely directed formations of the other parts does not function when these parts are made of sheet metal.

According to further features of this invention each of these tabs is of inwardly open V-section. They extend at an angle of at least 60° to the plane of the web. Each of the lips is flat and lies in surface contact on the repective web end, whereas each of the V-section tabs engages the edge of the respective aperture only in line contact.

It has been found that such an attachment system holds the two parts together securely during rotation at speeds as high as 8,000 RPM. Nonetheless when the disk is impacted, normally from beneath, by a few pellets from a standard shotgun load, the cap or witness part will separate surely from the propeller part and fall to the ground, and the propeller part in turn will normally flutter and only travel a short distance.

According to further features of this invention the cap or witness part is provided with two further lips diametrically offset from each other and spaced at 90° from the first-mentioned lips. These lips are not formed with apertures. Thus when the target pigeon is spun at high speed the slightly greater weight of these lips will slightly deform the cap so as to stretch it along a diameter perpendicular to the web, thereby ensuring extremely good holding of the disk on the tabs. The small increase in weight due to the fact that these other counterbalance lips are not perforated becomes an important factor when the target pigeon is rotated at high speed.

According to yet another feature of this invention the two vanes are shaped as air foils, that is they are slightly concave downwardly in a direction opposite the direction of extension of the attachment tabs. What is more the vanes each extend along a diametral centerline, and each vane lies almost exactly one half to one axial side of this centerline and one half to the opposite axial side of this centerline. The centerlines in turn pass through the exact longitudinal central axis of the web. Thus even when spun at high speed the vanes will not deform, and the target pigeon will fly in a manner that closely imitates that of a live bird released from a box.

According to further features of this invention the interior of the target pigeon is provided with marker means for visibly indicating when the two parts have separated. This can be done according to the instant invention by providing a very light gas-tight capsule between the two parts of the pigeon. When the pigeon is separated this capsule will inevitably burst. It can be filled with a colored gas that plainly marks the score. In addition it is possible to provide a vessel on one of the parts of the target pigeon which is open toward but normally closed by the other part. This vessel can be filled with a relatively light material such as feathers or small pieces of an expanded synthetic-resin foam. With such an arrangement when the two parts separate the vessel is effectively opened and the marker material is released.

BRIEF DESCRIPTION OF THE DRAWING

FIG. 1 is a perspective view of the target pigeon according to this invention in assembled condition;

FIGS. 2 and 3 are perspective and top views, respectively, of the propeller part and cap part of the target pigeon;

FIG. 4 is a view taken in the direction of arrow IV of FIG. 2;

FIG. 5 is a section taken along line V—V of FIG. 1, in enlarged scale;

SPECIFIC DESCRIPTION

Figure 6:
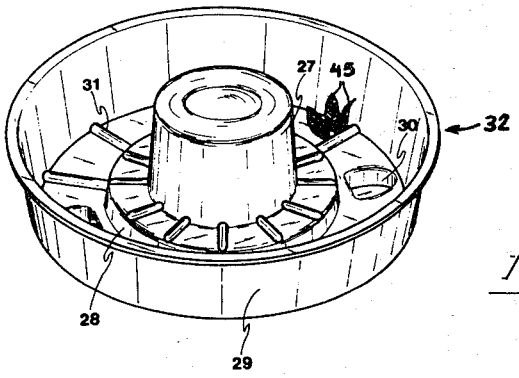
FIG. 6 is a perspective view of a marker-material container according to this invention.

As shown in FIGS. 1–5, the target pigeon according to the instant invention basically comprises a cup-shaped witness part or disk 2 and a base or propeller part 5. Both are made of sheet steel of of a thickness smaller than 0.5 mm. The propeller part has a central web 1 formed with a central hole 4 centered on an axis A and with a pair of diametrically opposite wings or vanes 3. Offset from this central circular hole 3 is a pair of drop-shaped holes 5 and 6 whose inner pointed ends are formed with bent-over flanges 7 and 8 whose purpose will be described below. Most of the web 1 lies in a plane perpendicular to the axis A and including an axis A′ passing through the centers of the wings 3. The two parallel longitudinal edges of the web 1 are bent over at short lips or flanges 14 and 15 so as to longitudinally stiffen this web 1. Furthermore adjacent its ends the web 1 is formed with transverse stiffening ribs 11 and 12.

As shown in FIG. 4 each of the wings 3 is curved airfoil-fashion and is generally fan shaped. The outer edges 20 of these wings 3 are outwardly convex, having a center of curvature at the axis A. In addition each of these wings has a leading edge which lies somewhat closer to a plane P of the respective wing than the trailing edge, for creating lift. The wings 3 are connected to the ends of the web 1 at bent regions 16–19. This particular shape, which is substantially different from the planar square-ended shape of the hitherto used synthetic-resin target pigeon, has been found to impart substantially more lift so that for a given launch RPM, e.g. 6,000 RPM, substantially higher travel speed is possible. Thus it is possible to operate the launcher at a lower speed to obtain a given flight characteristic. The result is, of course, a saving in energy and wear for the launcher.

The web 1 is formed adjacent each of its ends, between the respective downwardly projecting reinforcing rib 11 and the bent region 16–19, with V-section inclined holding pins or tabs 9 and 10 extending axially and inclined outwardly as shown in FIG. 5 at an acute angle of 75°. In addition the cup-shaped and stepped cap 2 is formed with a pair of opposite lips 21 and 22 formed with respective throughgoing rectangular holes 25 and 26 through which these tabs 9 and 10 can engage. The diameter relative to the axis 8 between the outer edges of the apertures 25 and 26 is substantially equal to the diameter between the lower edges of the tabs 9 and 10. Thus these tabs 9 and 10, which have an axial height equal to substantially more than the thickness of the tabs 21 and 22, will engage these tabs 21 and 22 at the respective outer ends of the apertures 25 and 26 in line contact at one location. Thus these tabs 9 and 10 serve not only to hold the cap 2 on the propeller part 5, but center the axis A of this cap 2 with the axis A of the propeller part 5 defined by hole 4. What is more the planar lips 21 and 22 lie flatly on the web 1 so that a firm seating of the parts 2 and 5 is ensured. Th cap 2 is formed angularly equispaced between the lips 21 and 22 with two further counterweight formations or lips 23 and 24 which are formed without apertures, so that they have slightly more mass than the lips 21 and 22. In this manner when the entire target pigeon is spun rapidly about the axis A the slightly greater weight of the lips 23 and 24 will tend to ovalize the cap 2, pulling the flaps 21 and 22 toward each other radially so as to increase the holding effect with rotation speed. Absent these flaps 23 and 24 when rotated at high speed the tabs 21 and 22 would ovalize the cap 2 along a major axis through the holes 25 and 26 and allow it to come free of the base part 5.

Figure 7:
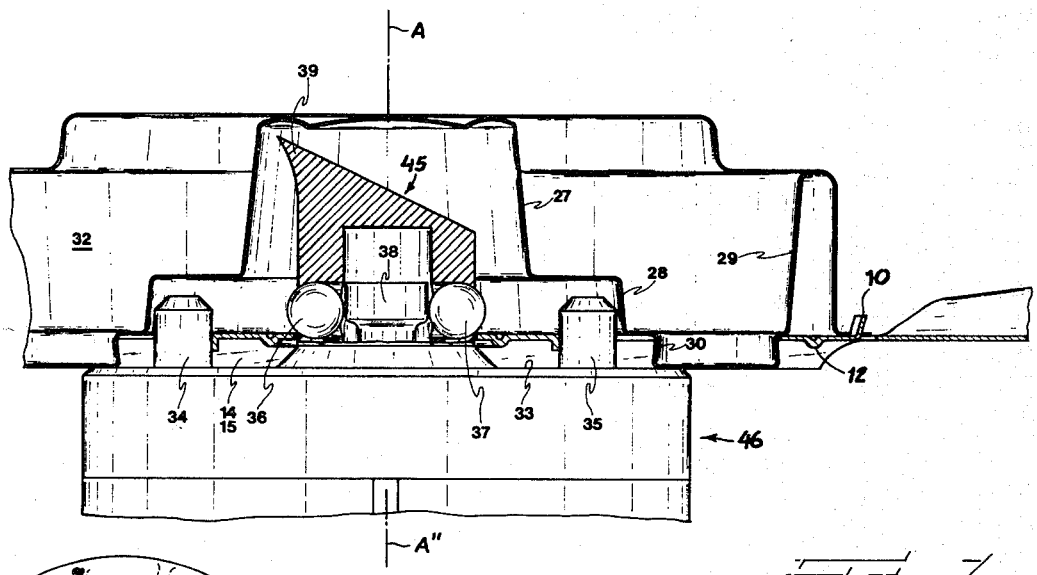
FIG. 7 is a large-scale axial section showing a portion of the target pigeon according to this invention.

FIG. 7 shows how the target pigeon is intended to fit on a launch head 46 of the type described in my U.S. Pat. No. 4,077,384. This launch head 46 is rotated about a central axis A″ extending perpendicular to an end face 33 of the head 46. Two diametrically opposite pins 34 and 35 spaced from the axis A″ fit axially through the inner edges of the holes 5 and 6 to the inner edges thereof where the reinforcing lips 7 and 8 are formed. These lips 7 and 8 prevent the edges of the sheet metal of the web 1 from biting into the pins 34 and 35. In addition the launch head 46 has a tip 47 provided with a pair of balls 36 and 37 displaceable radially by a ball-operating pin 38, and this tip 47 is formed with a laterally extending beak or hook 39. The tip 47 fits through the hole 4, which itself has a circular reinforcing rib 13 to prevent the balls 36 and 37 from deforming the sheet metal of the web 1.

Rotation of the head 46 at high speed, up to 8,000 RPM, will similarly rotate the entire target pigeon by angular force transmission between the pins 34 and 35 and the web 1 and through the holding tabs 9 and 10 to the cap 2. The balls 36 and 37 are positively held in the outer position by the widened end of the pin 38 so that only when this pin 38 is axially advanced can the balls 36 and 37 retract so that the target pigeon will fly off the head 46, being laterally deflected by the beak 39. Thus this target pigeon can be used on a standard launcher set up for the prior-art synthetic-resin target pigeons.

It is, of course, possible to replace the solenoid-operated pin 38 with a simple electromagnet in the head 46, so that all moving parts are eliminated in the holding mechanism for the target pigeon. In such case the target pigeon will be released merely by open-circuiting the electromagnet so that the sheet-metal web would no longer be held magnetically against the head 46. The two longitudinal reinforcing ribs 14 and 15 stand on the face 33 so as to hold the entire target pigeon in an exact position parallel to the surface 33. In fact the overall height of the sheet-metal web 1, including the reinforcing lips 14 and 15, is identical to that of a standard, much thicker synthetic-resin pigeon.

According to further features of this invention it is possible to provide the target pigeon with a marking means which can be constituted as a synthetic-resin cup or vessel 32 having an outer wall 29, a bump having a raised central part 27 and peripheral part 28, and formed with two further substantially round bosses 30 adapted to fit in the holes 5 and 6 radially outside the pins 34 and 35. The floor of the vessel 32 is formed with radial stiffening ribs 31. Such a vessel is filled with light matter such as feathers 45.

FIG. 7 shows how the vessel 32 is fitted to the web 1 with its bump 30 received in the holes 5 and 6 and with its upper edge just touching the inside surface of the cap 2 standing on the face part 5. In addition the stepped portions 27 and 28 easily accommodate the pins 34 and 35 and the tip 47. The overall weight of this vessel 32, even when filled with feathers, is negligible and has virtually no effect on the flight characteristic of the target pigeon.

When such a target pigeon is successfully shot, so that its two parts 2 and 5 separate, the effect is spectacular, with the feathers flying out and creating an easily visible indication of the successful hit, in fact resembling the feathers flying off a live pigeon that has been shot. It is possible, of course, to replace the feathers 45 with some other light material, such as light beads of a closed-cell synthetic-resin foam, tissue paper, or the like.

Figure 8:
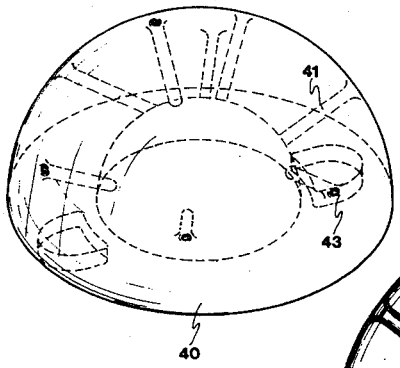
FIGS. 8 and 9 are perspective and side views, respectively, of another marker element according to the present invention.
Figure 9:
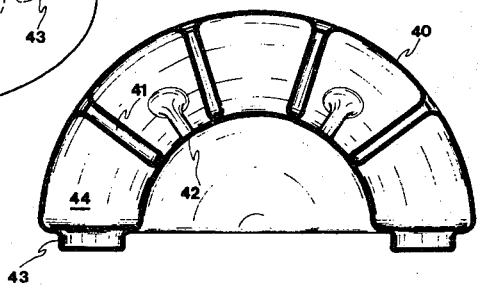

FIGS. 8 and 9 show a latex capsule 40 formed with bumps 43 identical to the bumps 30 and having an inner wall 42 secured via reinforcing tubes 41 to the outer wall of the capsule. The interior 44 of this capsule 40, which is of generally semispherical shape, is filled with a colored gas that, when the target pigeon is scored with a hit, is released to indicate the successful hit.

With both such arrangements the relatively large holes 5 and 6 not only serve to retain the indicator tightly on the web 1, so that the pins 9 and 10 are not loaded torsionally excessively by the extra structure, but these holes 5 and 6 also allow further access of shotgun pellets through the web 1 to the underside of the cap 2, ensuring the separation on any solid hit.

In use it has been found that the attachment using exclusively the pins 9 and 10 not only gives a good radial connection between the two parts 2 and 5 of the target pigeon, but ensures perfect centering of the disk 2 with good separation whenever the target pigeon is solidly shot.

As described in my above-cited U.S. Pat. No. 4,077,384 the target pigeons are invariably launched so that they fly away from the shooter. Thus the bottom of the target pigeon is always turned toward the shooter so that at least some of the pellets of a good shot will impinge directly on the underside of the cap 2. With the target pigeon described above even a few pellets impinging the bottom of the cap 2 will always ensure separation and scoring of the hit. The provision of a single diametral web 19 rather than complex ring structures to hold the cap 2 in place on the center, means that substantially more area of the cap 2 is exposed to be impacted by pellets from the shotgun. As a result any shooter can be assured that if even only a few pellets strike the cap 2, the parts 2 and 5 will separate for scoring of the hit.

It has also been found according to the instant invention that the sheet-metal target pigeon is extremely durable. Such a target pigeon if not shot can almost invariably be used again. Even when shot several times, it is frequently possible to reuse the parts of such a target pigeon made of inexpensive sheet steel, so that the unit cost for the arrangement is extremely low. What is more, the target pigeon is made of sheet metal so that it is possible not only to do away with complex mechanism in the launcher for holding the pigeon in place on its head, but in addition it is possible to collect the target pigeons by means of an electromagnetic rake provided on a tractor that sweeps the shooting area at the end of the day, thereby saving expensive manpower. The target pigeons made of sheet metal do not shatter in several pieces like the synthetic-resin pigeons, even when solidly shot, so that the shooting area can be kept relatively neat. Finally it is noted that even if left in place in the shooting area the target pigeons will rust and disintegrate with time, with no substantial environmental degradation as the iron oxide which they become is an ecologically inoffensive compound.

It is of course possible to make the target pigeons according to this invention of a good grade of relatively elastic sheet steel, even of stainless steel. Flash inductive tempering of the sheet-steel target pigeons increases their service life many times, sufficiently to economically justify this extra treatment step in their manufacture.

I claim:

1. A target pigeon comprising:

a generally flat web formed entirely of sheet metal with a central throughgoing hole at a web axis and having a pair of diametrically opposite web ends;

a pair of sheet-metal vanes on said web extending diametrically oppositely from said web ends and tipped propeller-fashion to each other;

a pair of substantially upright, generally axially projecting, and oppositely outwardly tipped sheet-metal tabs on said web ends diametrically opposite each other and having a predetermined axial height above said web; and a cup-shaped witness cap formed entirely of sheet metal and having a substantially circular rim centered on a cap axis and having one axially directed rim end engageable with said web at said web ends between said tabs and another opposite axially directed rim end, a pair of diametrically opposite and radially outwardly projecting lips on said one rim end and formed with respective throughgoing apertures through which said tabs can project with said one rim lying snugly on said web ends, a pair of diametrically opposite formations of mass greater than said lips on said rim between said lips, and an end plate extending across and closing said rim at said opposite rim end.

2. The target pigeon defined in claim 1 wherein said tabs are of V-section, open inwardly seen in axial cross section.

3. The target pigeon defined in claim 2 wherein said apertures are substantially rectangular, whereby said tabs engage said lips at the respective apertures in at most line contact.

4. The target pigeon defined in claim 1 wherein said formations are a second pair of such lips, said lips being angularly substantially equispaced.

5. The target pigeon defined in claim 4 wherein said lips of said second pair are substantially identical to the lips of the first-mentioned pair but are free of apertures.

6. The target pigeon defined in claim 1 wherein said web has a pair of generally parallel secantally extending edges each formed with a bent-down stiffening flange.

7. The target pigeon defined in claim 1 wherein said web is formed at each of said web ends with a stiffening rib extending transversely to said web.

8. The target pigeon defined in claim 1 wherein each of said vanes has a centerline lying on a radius of said web axis and each of said vanes lies substantially half to one axial side of the respective centerline and substantially half to the other axial side thereof.

9. The target pigeon defined in claim 8 wherein each of said vanes is curved in the manner of an airfoil.

10. The target pigeon defined in claim 1 wherein said cap is substantially rotation-symmetrical about said cap axis except for waid lips.

11. The target pigeon defined in claim 1, further comprising:

a vessel removably mounted on said web and open toward said cap, said cap closing said vessel when secured by said tabs to said web; and a mass of relatively light material filling said vessel.

12. The target pigeon defined in claim 11, wherein said material is feathers.

13. The target pigeon defined in claim 1, further comprising:

a sealed frangible capsule in said cap between same and said web; and a colored gas filling said capsule.

14. A target pigeon comprising:

a propeller part having a web centered on and transverse to a web axis and having a pair of web ends, and a pair of diametrically opposite vanes extending outwardly from said ends and tipped propeller-fashion to each other;

a witness part centered on a witness axis and having a rim engageable with said web ends;

means including interengaging formations on said parts for holding said parts releasably together with said axes aligned and said rim snugly engaged with said web and for freeing said parts from each other when impacted;

an axially open vessel releasably secured to one of said parts and open toward the other of said parts, said vessel being closed by said other part when said parts are held together by said formations; and a mass of light material in said vessel whereby when said parts are separated said light material is freed.

15. The target pigeon defined in claim 14 wherein said material is feathers.

* * * * *